US006138300A

United States Patent [19]

Burch et al.

[11] Patent Number: 6,138,300

[45] Date of Patent: Oct. 31, 2000

[54] FUTON FRAME

[75] Inventors: Jerry Burch; Dane Jones, both of Surrey, Canada

[73] Assignee: Renelle Furniture, Inc., Surrey, Canada

[21] Appl. No.: 09/340,611

[22] Filed: Jun. 28, 1999

[51] Int. Cl.[7] ..... A47C 17/17

[52] U.S. Cl. ..... 5/37.1; 5/41; 5/48

[58] Field of Search ..... 5/37.1, 41, 47, 5/48

[56] References Cited

U.S. PATENT DOCUMENTS

| | | | |
|---|---|---|---|
| 4,829,611 | 5/1989 | Fireman et al. | 5/47 |
| 4,875,244 | 10/1989 | Tremblay | 5/37.1 |
| 5,129,114 | 7/1992 | Withers | 5/47 |
| 5,146,640 | 9/1992 | Barton et al. | 5/47 |
| 5,153,952 | 10/1992 | Barton et al. | 5/47 |
| 5,303,432 | 4/1994 | Fitts | 5/37.1 |
| 5,315,722 | 5/1994 | Djie | 5/37.1 |
| 5,513,398 | 5/1996 | Dodge | 5/37.1 |
| 5,628,076 | 5/1997 | Newton | 5/37.1 |
| 5,664,268 | 9/1997 | Stoler et al. | 5/37 |
| 5,815,858 | 10/1998 | Dodge | 5/37.1 |
| 5,940,907 | 8/1999 | Stoler | 5/37.1 |
| 5,956,785 | 9/1999 | Fireman | 5/37.1 |

FOREIGN PATENT DOCUMENTS 1300815 5/1992 Canada .

OTHER PUBLICATIONS

Article entitled"The Evolution of the Futon mechanism" (pp. 22, 46 and 48) Part 1 from "Futon Life" Spring 1996.

Article entitled "The Evolution of the Futon Mechanism" (pp. 24, 44, 48 and 49) Part II from "Futon Life" Summer 1996.

*Primary Examiner*—Michael F. Trettel

*Attorney, Agent, or Firm*—Klarquist Sparkman Campbell Leigh & Whinston LLP

[57] ABSTRACT

A futon frame is convertible between a bed position and a sitting position and includes a back portion and a seat portion. The back portion is oriented generally upright when the frame is in the sitting position and is oriented horizontally when the frame is in the bed position. The seat portion is hingedly attached to the back portion to permit relative movement of the back portion with respect to the seat portion. A connector releasably connects the back portion and seat portion to cause the back portion to move on movement of the seat portion in a first direction about a pivot point. A support supports the back portion with respect to a supporting surface and the back portion includes a pair of opposed outer edges. A pair of first pins are provided, each connected to one of the outer edges of the back portion and the support and a pair of first slots, each in the other of the outer edges of the back portion and the support are provided for constraining movement of the first pins within respective first slots. Each first slot includes a contact surface preventing upward movement of the pins with respect to the first slots when the frame is in the bed position and curved such that the pins are releasable from the contact surface upon movement of the back portion in a pivoted direction, when the frame is moved from its bed position to its sitting position.

34 Claims, 6 Drawing Sheets

FUTON FRAME

FIELD OF THE INVENTION

This invention relates generally to a futon frame convertible between a sitting position and a bed position, and more particularly relates to a convertible futon frame which is moveable from a bed position to a sitting position in a smooth pivotal motion without the need for pulling the frame horizontally to unlock it from the bed position.

Convertible futon frames, which are convertible between a sitting position for use as a couch or sofa and a horizontal bed position are well known in the art. These frames generally include a seat portion for supporting the lower parts of an individual and a back portion for supporting the back of an individual when the futon frame is in a sitting position. The seat portion and back portion are hingedly connected to one another to permit those portions to be moved between a position where the frame is used for sitting, and a bed position where the seat portion and back portion are in horizontal alignment. The futon frame supports a soft futon mattress pad which moves with the frame between the sitting and bed positions.

Front operating convertible futon frames permit a user to convert the frame between a bed position and sitting position by rotating the seat portion at the front of the frame. The frame is also convertible from the sitting position to the bed position by pulling on the seat portion at the front of the frame. This enables one person to move the frame between these alternate positions without the need for assistance and without having to manipulate the frame at each end. Prior to this development, two persons, positioned at opposite ends of the frame, were often required to simultaneously raise or lower the back portion to convert the futon frame between a sitting position to a bed position and vice versa.

Front operating futon frames may include pins located at opposite ends of the back portion and slots located in a support which supports the frame with respect to the supporting surface such as a floor or other ground support. The pins travel within the slots as the bed is moved between the sitting position and the bed position to guide the back portion and to hold the back portion in the appropriate position when the frame is in the seating position and bed position.

The back portion of front operating futon frames may be pivoted upwardly from the horizontal position (when the frame is in the bed position) to a generally upright position (when the frame is in the seating position) by means of a pair of kickers. These kickers are hingedly attached to each outer edge of the seat portion and engage the back portion when the seat portion is moved upwardly from the bed position to a vertical position perpendicular with the back portion. Upon engagement of the kickers with the back portion and upon downward pivotal motion of the seat portion by the user, the back portion is forced upwardly guided by the pins within the slots which eventually orient the back portion in its upright, rearwardly slanted, position when the frame is in the sitting position.

These types of futon frames included a slot having a generally "L" shape to releasably lock the pins within the slots when the frame is in the bed position. The pins engage the lower horizontal portion of the slots when the frame is in the bed position thereby preventing vertical movement of the back and seat portions of the frame adjacent the hinge. This prevents the portions of the back section and seat section adjacent the hinge, for example, from moving downwardly when downward pressure is placed on the hinge as occurs during use of the futon frame for sleeping.

While this locking system had the advantage of preventing this vertical movement of the frame by releasably locking the pins in the slots, it also causes difficulties in converting the futon frame from a bed position to a seating position.

This locking system requires that the user first pull the futon frame horizontally towards the front of the frame in order to release the pins from the horizontal section of the slots by moving it to the bottom of the vertical portion of the slots. This permits the pins and the back portion to move upwardly along the vertical portion of the slots when the kickers are engaged and the seat portion is pivoted downwardly. Users who may not be familiar with this locking system or users who forget to unlock the frame by pulling horizontally can cause damage to the pins or slots by attempting to pivot the back portion upwardly using the kickers while the pins are locked in the lower horizontal section of the slot. Sufficient pressure on the seat portion can cause the pins to break or the slot to crack, seriously damaging the futon frame. As well, users can pull the frame unevenly releasing one of the pins from it corresponding slot horizontal section and not the other. Downward pressure on the seat portion with the kickers engaged to attempt to raise the back portion causes significant upward pressure is placed on the pin still locked in its corresponding slot horizontal section which can cause that pin to break or that horizontal section to split, causing damage to the frame.

In addition, separately pivoting kickers may not both engage the back portion when the seat portion is pivoted vertically with respect to the back portion. When only one of the kickers engage the back portion and upon downward pivotal pressure on the seat portion, the uneven pressure on the pins in the slots caused by uneven kicker engagement can also lead to breaking of a pin or splitting of the wood adjacent a slot. These difficulties can be exacerbated when both problems occur simultaneously, that is when one pin remains in the horizontal portion of its corresponding slot and one of the kickers does not engage the back portion. Downward pressure on the seat portion to attempt to pivot the back portion up into the seating position increases the pressure on the pins which increases the risk of a pin breaking or wood splitting adjacent a slot due to that increased pressure.

In order to ensure that these prior art front operating futon frames are not damaged when moved from the bed to sitting position, users must first ensure that the pins are both properly unlocked from the horizontal portion of the slot and then ensure that both kickers are engaged, before applying downward pressure on the seat portion to raise the back portion to the sitting position. However, users often do not check each side of the frame to ensure proper positioning of the pins and the kickers before applying downward pivotal pressure on the seat portion to attempt to raise the back portion to the sitting position. This can occur, for example, with users unfamiliar with these types of convertible futon frames, with users who are in a hurry or with forgetful or careless users.

As well, prior art frames which include kickers to raise the back portion provide a kicker hingedly connected to the seat portion at a position near the hinge connecting the back portion and the seat portion together. This results in considerable pressure placed on the pins within the slots when downward pressure is applied on the seat portion. This further exacerbates the risk of splitting the wood or otherwise damaging the support and slots or breaking a pin if an attempt is made to move the frame from the bed position to the seating position.

Locking types of futon frame, having a generally "L" shaped slot are exemplified by U.S. Pat. No. 5,664,268, to Stoler et al and U.S. Pat. No. 4,829,611 to Fireman.

As depicted in FIG. 6 of Stoler at al, frame 13 must be moved in a horizontal direction depicted by the arrow to unlock pin 27 from slot 21' before the frame can be moved to a sitting position as depicted in sequence in FIGS. 7 through 10. Fireman also requires an initial pulling of the frame in a forward direction to move pin 27 from the horizontal portion of an "L" shaped slot 32 before the bed frame can be moved to a sitting position by engaging kicker 28 on back portion 18 and moving back portion 18 downwardly in the direction of arrow B (FIG. 2) causing upward pivotal motion of back portion 18 in the direction of arrow C.

It can be readily appreciated with the Stoler et al and Fireman futon frames that if a user fails to disengage the pin from the horizontal component of the "L" shaped slot, pivotal movement of the back portion upwardly is prevented by the pin in the vertical segment of the slot, and downward pivotal pressure on the seat portion to pivot it downwardly with the kicker engaged, would prevent that pivotal motion or on increasing that pressure would either cause a pin to break within its corresponding slot or cause the wood adjacent the slot to split.

SUMMARY OF THE INVENTION

The present invention provides a convertible futon frame moveable between a sitting position and bed position without requiring users to unlock the frame to permit pivotal movement of the back portion when the frame is moved from the bed position to the sitting position. The back portion includes a pair of pins on opposite ends of the back portion engaged for slidable movement within respective slots in a support. The slots include a portion with an contact surface which engages the pin and prevents upward movement of the pin when the frame is in the bed position. The contact surface is positioned generally parallel with the initial pivotal direction of movement of the pin when the back portion is moved from the bed position to the sitting position. This allows the pin to engage the contact surface when in the bed position to prevent upward or downward vertical motion. The position of the contact surface also allows the pin to be smoothly released from the contact surface, without requiring an initial unlocking or releasing step, when the back portion is pivoted to the sitting position. A pair of kickers include a connecting portion to connect a pair of opposed body sections which are hingedly attached to the seat portion and are engagable with the back portion to raise the back portion in a pivotal direction upon downward pivotal movement of the seat portion. The body sections are hinged to the seat portion near the outer end of the seat edges away from the end of the edge adjacent the hinge to provide a large pivot radius of the kickers.

In the first embodiment of the invention, a futon frame is convertible between a bed position and a sitting position and includes a back portion and a seat portion. The back portion is oriented generally upright when the frame is in the sitting position and is oriented horizontally when the frame is in the bed position. The seat portion is hingedly attached to the back portion to permit relative movement of the back portion with respect to the seat portion. A connector releasably connects the back portion and seat portion to cause the back portion to move on movement of the seat portion in a first direction about a pivot point. A support supports the back portion with respect to a supporting surface and the back portion includes a pair of opposed outer edges. A pair of first pins are provided, each connected to one of the outer edges of the back portion and the support and a pair of first slots, each in the other of the outer edges of the back portion and the support are provided for constraining movement of the first pins within respective first slots. Each first slot includes a contact surface preventing upward movement of the pins with respect to the first slots when the frame is in the bed position and positioned such that the pins are releasable from the contact surface upon movement of the back portion in a first direction, when the frame is moved from its bed position to its sitting position. The frame may include contact surfaces having a radius of from between about 45 mm and 55 mm. In a more preferred embodiment the contact surfaces have a radius from between about 48 mm and 52 mm and in a most preferred embodiment the radius is about 50 mm.

The frame contact surfaces may be oriented generally parallel to the first direction of movement of the back portion when the frame is moved from its bed position to its sitting position.

A kicker is further provided for a futon frame convertible between a sitting position and a bed position, the futon frame including a seat portion have outer and inner ends, the seat portion hingedly connected to a back portion. The kicker includes a pair of elongated body sections each having a first end hingedly connected to the seat portion and a second end for contacting the back portion, joined together by a connecting portion. A pair of kicker contact areas connected to the back portion are provided for contacting respective second ends of the body sections, located below the hinge when the frame is in its sitting position. The length of each body section is substantially equal to the distance between the outer end of the seat portion and the inner end of the seat portion. The connecting portion causes each body section to operate in a coordinated manner with the other body section to simultaneously engage and disengage the kicker from the kicker contact area.

A guide for a back portion of a sofa bed frame is provided, the bed frame convertible between a bed position and a sitting position, the guide includes a support for supporting the back portion with respect to a support surface, a pin connected to one of the support and the back portion, the pin moving when the frame is moved from the bed position to the sitting position, a slot in the other of the support and the back portion oriented to constrain the pin to move within the slot, the slot including a contact region contacting the pin when the bed frame is in the bed position to prevent vertical movement of the pin in the slot and positioned so that the contact region is substantially parallel with the direction of movement of the pin when it moves upon initial movement of the back portion when the frame is moved from the bed position to the sitting position.

DETAILED DESCRIPTION

Figure 1:
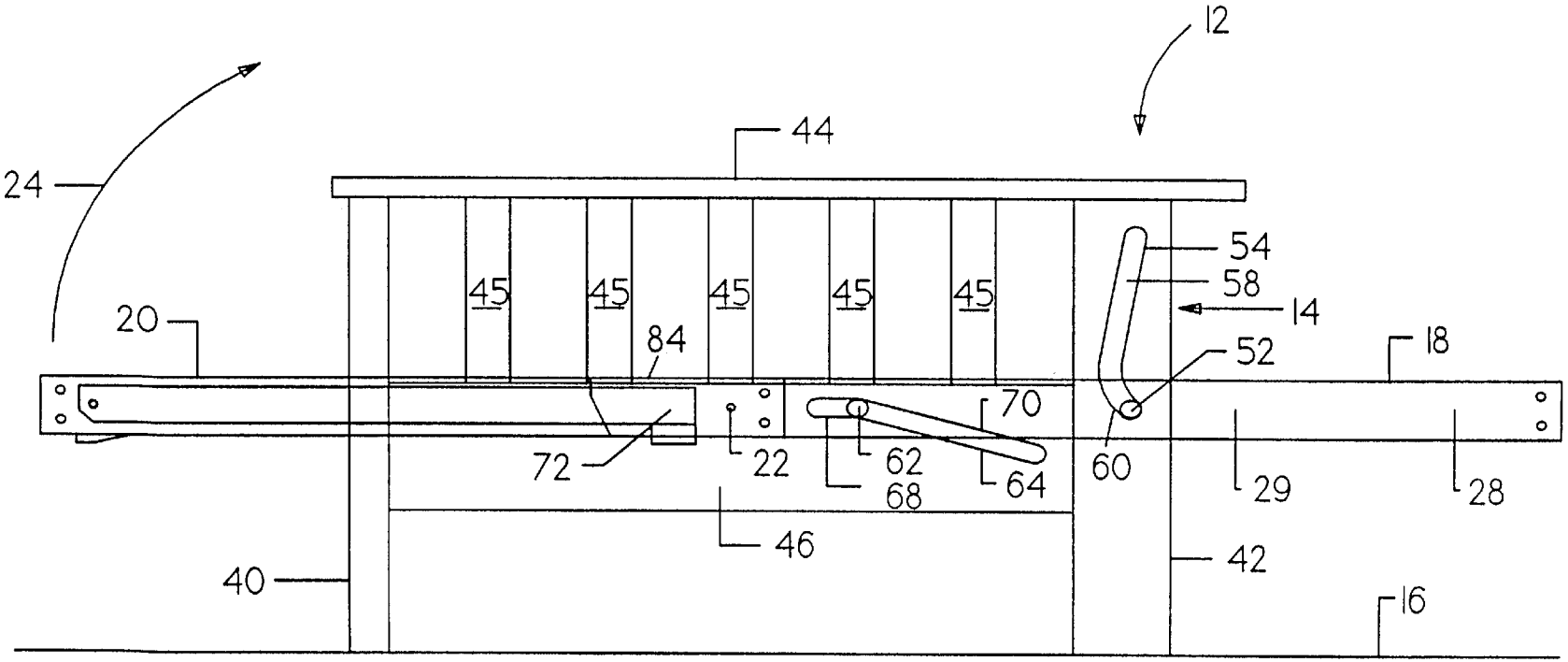
FIG. 1 is a vertical sectional view of the futon frame in the bed position.
Figure 2:
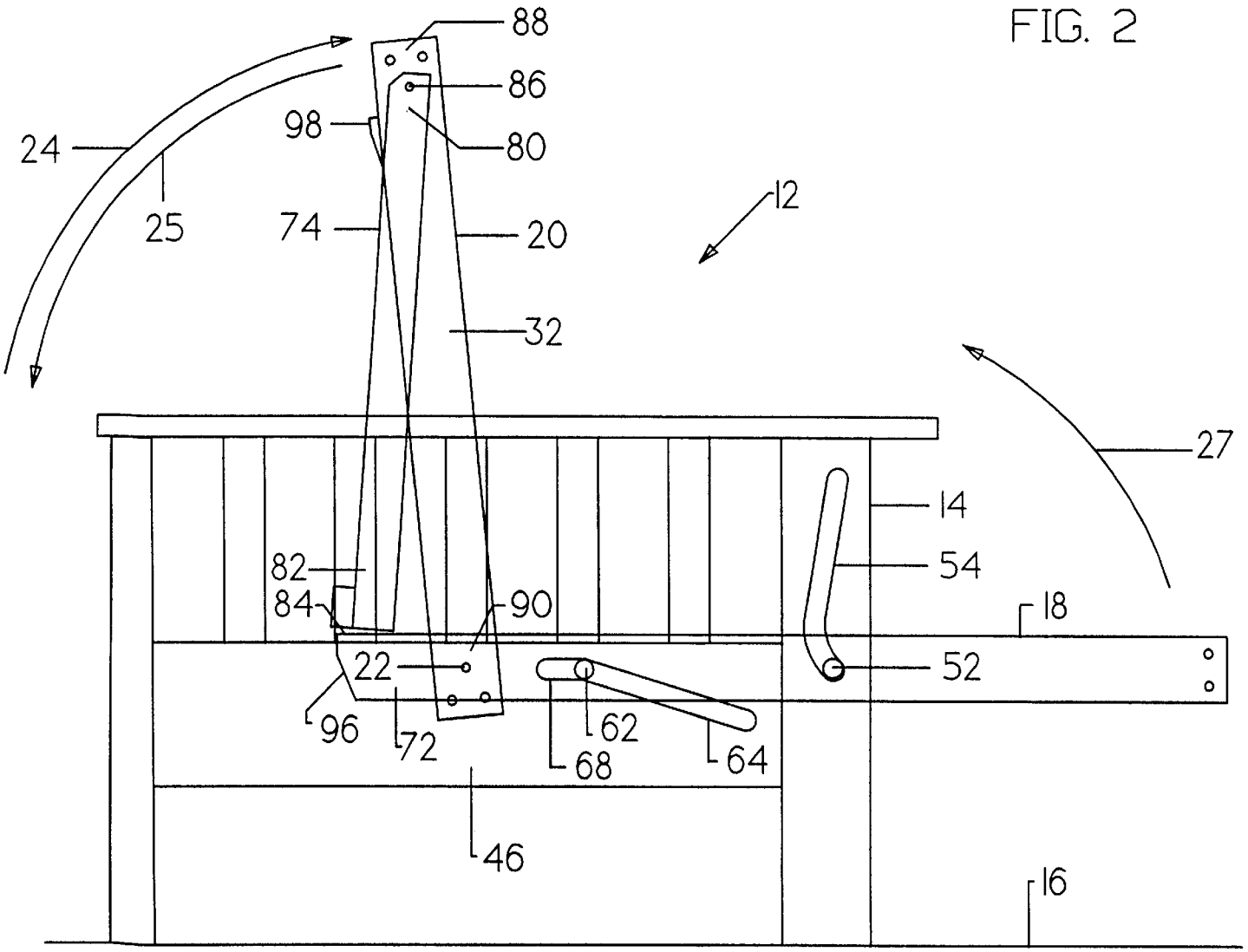
FIG. 2 is a vertical sectional view of the frame of FIG. 1, in position for engaging the kickers.
Figure 3:
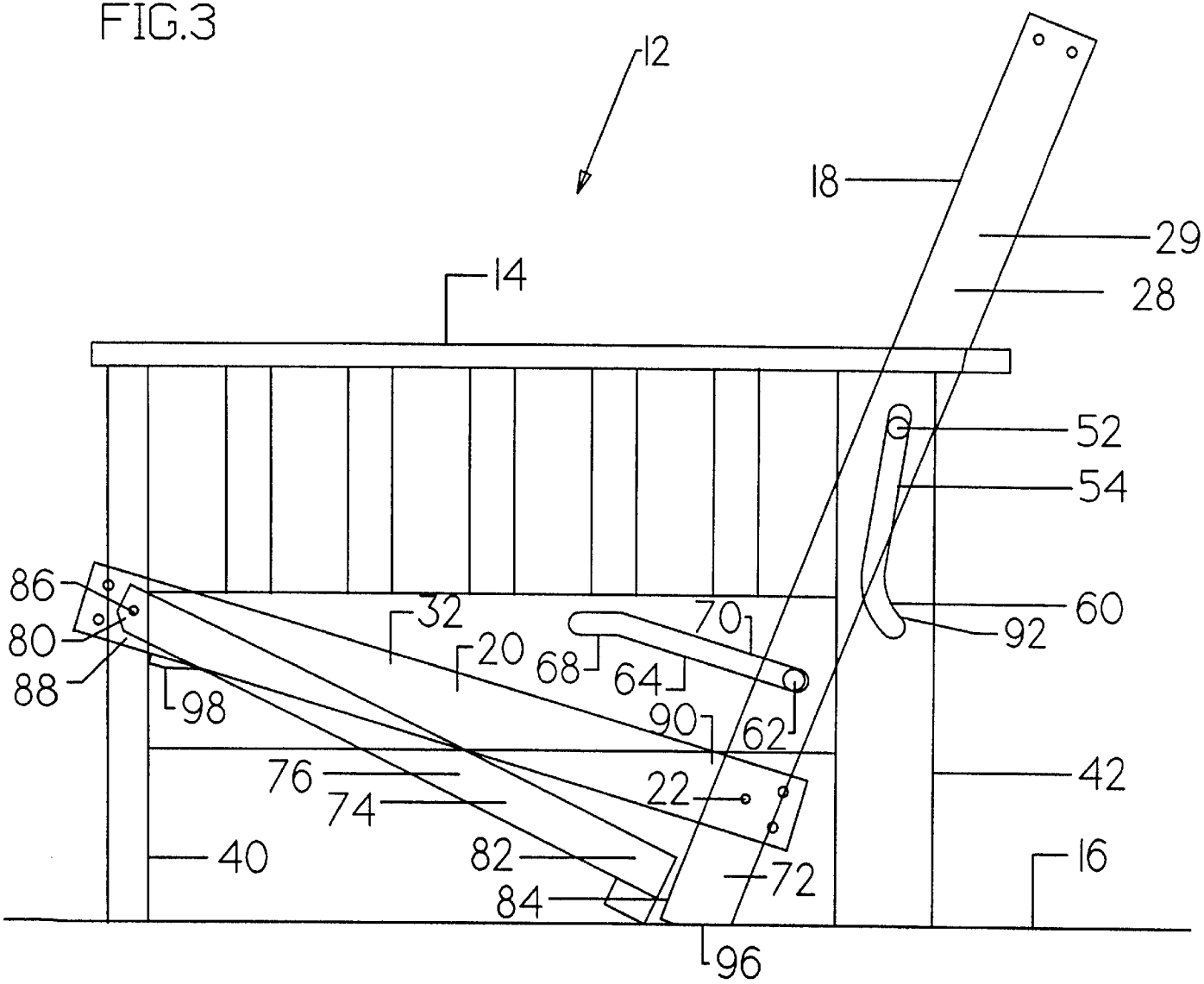
FIG. 3 is a vertical sectional view of the futon frame of FIG. 1, in the sitting position.

Referring to FIGS. 1, 2 and 3, futon frame 12 is shown in a side view. For ease of reference, a futon mattress which is usually placed on the frame is not shown in the drawings.

Frame 12 includes a pair of opposed supports 14 supporting the futon frame 12 with respect to a supporting surface 16.

Figure 4:
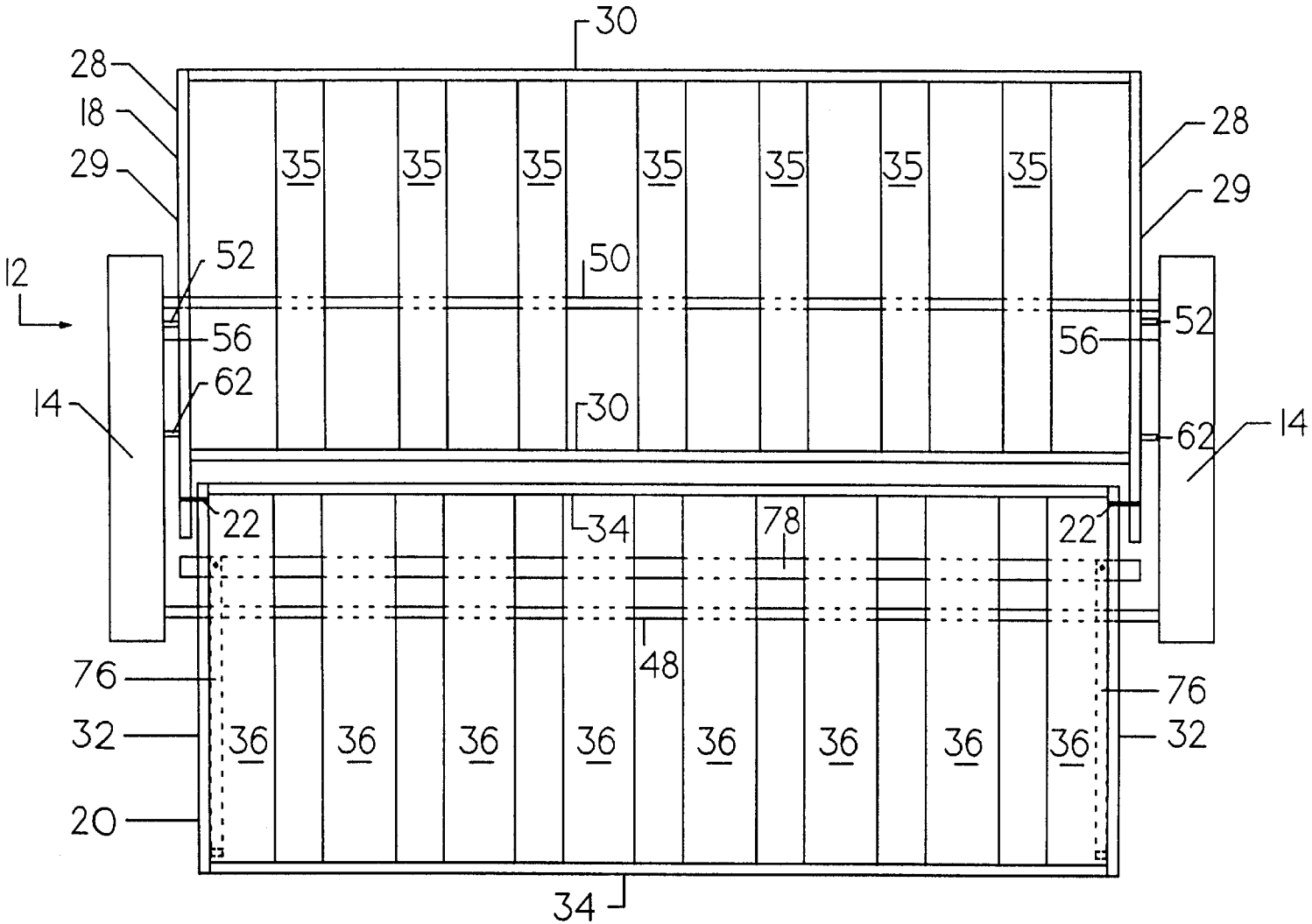
FIG. 4 is a top plan view of the futon frame of FIG. 1, in the bed position.

Frame 12 includes back portion 18 and seat portion 20 connected together by means of hinge 22, seen best in FIG. 4. Hinge 22 permits relative pivotal movement of seat portion 20 with respect to back portion 18 about hinge 22, in the direction of arrow 24 and as well in the direction of arrow 25, depicted in FIG. 2.

Referring to FIG. 4, back portion 18 is generally rectangular in shape with a pair of opposed end members 28 connected to a pair of opposed side members 30. Each end member 28 includes an opposed outer face or edges 29. A plurality of parallel spaced support members 35 extend between opposite side members 30 to provide support for the futon mattress (not shown) and the frame 12.

Similarly, seat portion 20 includes a pair of opposed end members 32 connected at their ends to a pair of opposed side member 34 to form a generally rectangular shape. A plurality of parallel spaced support members 36 extend between opposite side member 34 to provide support for the futon mattress (not shown) and the frame 12.

Each of supports 14 includes front leg 40 and rear leg 42 for supporting frame 12 on support surface 16. Arm rest 44 is connected to and extends horizontally between legs 40 and 42. Horizontal brace 46 is connected to inner sides of legs 40 and 42 and joins legs 40 and 42 together to provide additional support and rigidity to supports 14. A plurality of vertical support members 95 extend between arm rest 44 and brace 46 to support arm rest 44.

Front cross brace 48 (seen best in FIG. 4) extends between opposite leg 40 of each support 14. Rear cross brace 50 extends between and connects rear leg 42 of support 14. Each pair of supports 14 connected by front cross brace 48 and rear cross brace 50 forms a rectangular supporting element which supports back portion 18 and seat portion 20 between supports 14.

A pair of first pins 52 extend outwardly from respective edges 29 positioned generally midway between the ends of members 28. Each rear leg 42 includes a first slot formed in an inner side 56 (see FIG. 4) of each back leg 42. Each pin 52 travels within a corresponding slot 54 and is constrained for movement within that first slot 54. Pins 52 are retained in slot 54 as leg 42 is connected together by rear cross brace 50 which sandwiches back portion 18 between leg 42 with pins 52 in slot 54. Legs 42 are spaced apart sufficiently by rear cross brace 50 to provide sufficient space to permit pins 52 to slide in slot 54.

Slot 54 includes an upper, generally vertical region 58 angled rearwardly moving from the bottom of vertical region 58 to the top of vertical region 58 at an angle of about 9 degrees from the vertical. Slot 54 further includes a curved region 60 which curves rearwardly moving from the top of the curved region to the bottom of the curved region. This results in a generally "J" shaped first slot 54 in each leg 42 although one slot 54 is formed as a "true" J shape, the other slot formed as a reversed J shape as both curved regions 60 of slot 54 extend rearwardly moving from the top to the bottom of curved region 60. Pin 52 is free to travel within slot 54 between its lower most extremity, that being the lower part of curved region 60 (as depicted in FIG. 1) and upwardly generally adjacent to the upper part of vertical region 58, as depicted in FIG. 3, upon corresponding movement of back portion 18.

A pair of second pins 62 extend outwardly from respective edges 29 of end members 28 in longitudinal alignment with pins 52, pins 62 oriented generally adjacent hinge 22. Horizontal brace 46 each include a second slot 64 formed in an inner side of each pair horizontal brace 46. Each second pin 62 travels within a corresponding second slot 64 and is constrained for movement within that second slots 64. Pins 62 are retained within slot 64 by means of cross braces 48 and 50 which maintain opposed brace 46 in parallel alignment and which sandwich back portion 18 between brace 46 with pins 62 in slot 54. Opposite brace 46 are spaced apart sufficiently by cross braces 48 and 50 to permit second pin 62 to slide in second slots 64 between a generally forward position toward the seat portion 20, as depicted in FIGS. 1 and 2, and a rearward position when the frame is in the sitting position, as depicted in FIG. 3.

Second slots 64 include a forward horizontal portion 68 which is in alignment with the bottom of curved region 60 of slot 54 along edges 29. Second slots 64 also include rearward downwardly angled portions 70 connected to horizontal portions 68 and extending downwardly toward respective legs 42 to a position below the lower boundary of edges 29 when frame 12 is in the bed position.

Hinge 22 extends across parallel adjacent side member 30 of back portion 18 and adjacent side member 34 of seat portion 20. End members 28 of back portion 18 extend beyond hinge 22 to overlap a portion of end members 32 to form contact extensions 72 which are positioned below hinge 22 when the frame is in the sitting position, as depicted in FIG. 3. This orientation enables a user to pivot back portion 18 upwardly to the sitting position by applying pivotal force downwardly from above on contact extensions 72 thereby forcing pin 62 downwardly along angled portion 70 and pin 52 upwardly along curved region 60 and then upwardly along vertical region 58 to an upper region of slot 54.

Figures 5A, 5B:
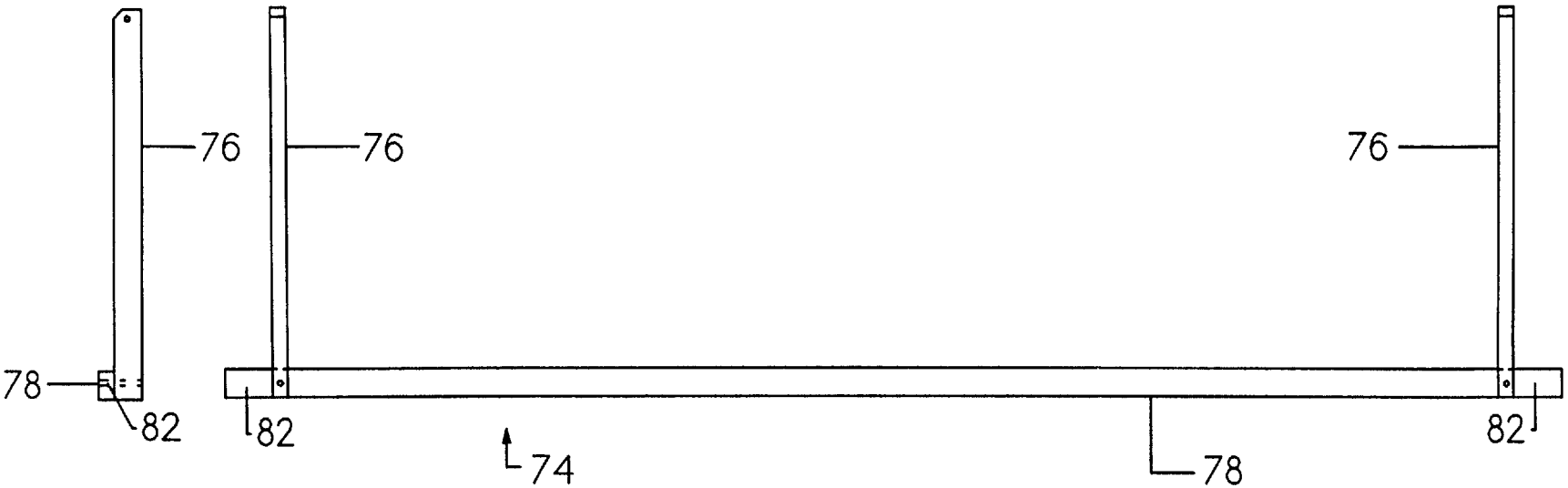
FIG. 5A is an end view of the kicker of the frame of FIG. 1.
FIG. 5B is a top plan view of the kicker of the futon frame of FIG. 1.

As best depicted in FIGS. 5A and 5B, and FIG. 3, kicker 74 includes spaced opposed parallel elongated body sections 76 joined together by a transverse connecting portion 78. Connecting portion 78 is dimensioned in length sufficient to orient body sections 76 adjacent respective end members 32 of seat portion 20. First end 80 of each body section is hingedly connected to adjacent end members 32 for pivotal movement of body sections 76 between a position aligned with end members 32, as depicted in FIG. 1 and a contact position wherein second end 82 of body section 76 is located below end members 32 for contact with contact extension 72. Upper face 84 of contact extension 72 forms a kicker contact area connected to the back portion 18 which contact the second end 82 of body section 76 at both end members 28 of back portion 18.

It will be readily apparent that due to connecting portion 78 connecting opposed second ends 82 together, second ends 82 will act in coordinated manner either engaging or disengaging from opposed kicker contact areas together. Pivot 86 pivotally connects first end 80 of body section 76 to outer end 88 of end members 32. This results in body section 76 being substantially equal to the distance between outer end, in this case outer end 88, and inner end 90 of end members 32, and of seat portion 20. Orienting pivot 86 at the outer end 88 with a relatively long body section 76 extending to an inner end contacting face 84 provides a greater degree of control by a user, as it reduces the amount of force which can be applied to contact portion 78 as compared to a shorter kicker of the prior art hingedly connected to end members 32 at or near inner end 90. As well pivot 86 and the spacing of body section 76 by connecting portion 78 with respect to end members 32 provide sufficient clearance to enable free movement of kicker 74 between the aligned position, as depicted in FIG. 1 and the kicker contact position of FIGS. 2 and 3 by the user or simply by force of gravity when seat portion 20 is raised or lowered.

Figure 6:
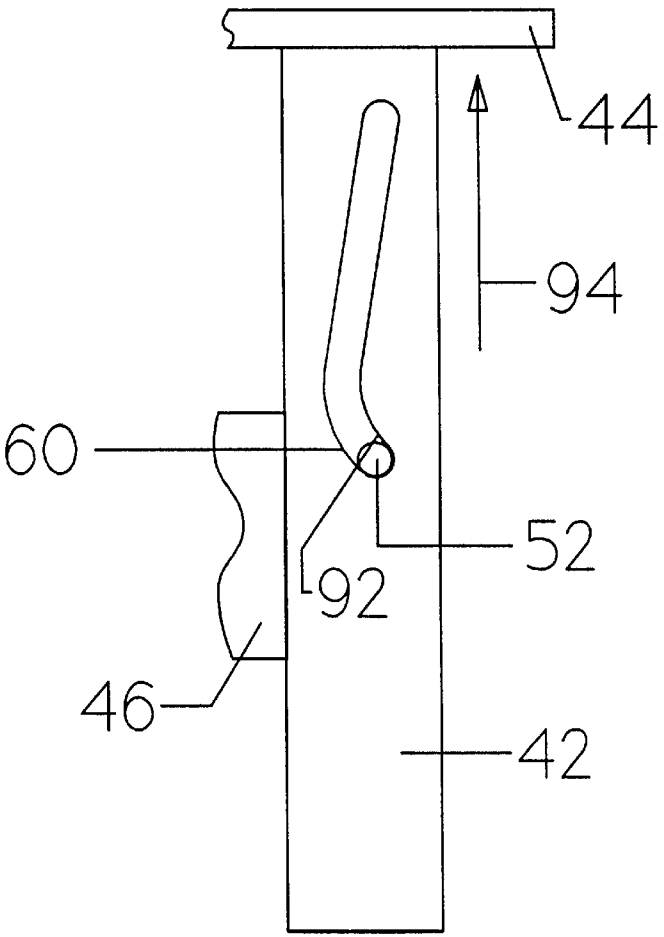
FIG. 6 is a close-up side view of the pin in the slot of the futon frame of FIG. 1.

Referring to FIG. 6, curved region 60 includes contact surface 92 (see also FIG. 3) at the upper side adjacent the lowermost part of region 60. Contact surface 92, in the case of the preferred embodiment is curved of radius generally about 50 mm forming a section parallel with the direction of movement of pin 52 on initial pivotal movement of back portion 18 in the direction of arrow 27 when frame 12 is moved from the bed position to the sitting position. This enables pin 54 to move smoothly without impediment past contact surface 92 and upwardly along slot 54 when frame 12 is moved from the bed position to the sitting position. When frame 12 is in the bed position, the radius of contact surface 92 is sufficiently small to provide sufficient friction on pin 52 to prevent movement of pin 52 in an upward direction, in the direction of arrow 94 (FIG. 8), thereby preventing vertical movement of back portion 18 when frame 12 is in the bed position, as depicted in FIG. 1. This is important as this contact between pin 52 and contact surface 92 prevents the regions of back portion 18 and seat portion 20 which are adjacent hinge 22 from moving upwardly when weight is placed on seat portion 20 or back portion 18 thereby retaining seat portion 20 and back portion 18 in a horizontally aligned position for use as a bed. A radius of 50 mm is most preferred to permit unimpeded movement of pin 54 past contact surface 92 when frame 12 is moved from the bed position to the sitting position and to prevent vertical movement when frame 12 is in the bed position. Also preferred is a radius of contact surface 92 of between about 48 mm and 52 mm. As well a broader range of radius of the curved region which will achieve these desired results is between about 45 mm and 55 mm. Radii lower than 45 mm will tend to cause difficulties in releasing pin 54 from contact surface 92 when frame 12 is moved from the bed position to the sitting position. Radii higher than 55 mm will tend to cause the undesirable release of pin 54 from the contact surface when frame 12 is in the bed position causing the seat portion 20 and back portion 18 to fall below the horizontal aligned position downwardly at the area adjacent hinge 22, particularly when weight is placed on portions 18 and 20 as when frame 12 is in use for sleeping.

In addition to pin 52 against contact surface 92, pin 62 within horizontal portion 68 acts to further retain back portion 18 in its horizontal position aligned with seat portion 20 when frame 12 is in the bed position.

Referring to FIG. 4, front cross brace 48 also supports seat portion 20 between front leg 40 when frame 12 is in any position of movement. Similarly rear cross brace 50 supports back portion 18, between rear legs 42 when frame 12 is in the bed position and as it is moved to the sitting position. However due to the upward position of back portion 18, slanted only slightly from the vertical, only slight support by rear brace 50 of back portion 18 occurs when frame 12 is in the sitting position. Front and rear cross braces 48 and 50 are oriented in horizontal alignment so that seat portion 20 and back portion 18 are retained in an aligned horizontal orientation assisted by pins 52 contacting contact surfaces 92 and pins 62 within horizontal portions 68.

Referring to FIG. 3, front cross brace 48 (not shown) also supports outer end 88 of end members 32 when frame 12 is in the sitting position. Rear cross brace also supports back portion 18 and prevents rearward movement of back portion 18 past rear cross brace 50 when frame 12 is in the sitting position. Contact extension 72 also includes angled support region 96 which contacts the contact surface 16 and supports back portion 18 and seat portion 20, when frame 12 is in the sitting position.

Stop 98 is attached below each end members 32 adjacent outer end 88 and positioned to contact front brace 48 to prevent forward movement of seat portion 20 when frame 12 is in the sitting position. Outer end 88 must be lifted upwardly to disengage stop 98 from front cross brace 48 before seat portion 20 may be moved forwardly with respect to cross brace 48. Without stop 98, and when frame 12 is in the sitting position, the weight of a user sitting in the seat could cause seat portion 32 to move in a forward direction which is not desired.

OPERATION

The steps required to move the frame between the bed position and the sitting position, and then back from the sitting position to the bed position will now be discussed with particular reference to FIGS. 1, 2 and 3.

Referring initially to FIG. 1, frame 12 is initially in the bed position locked in place with respect to vertical movement by pins 52 in slot 54 contacting contact surface 92, pins 62 in horizontal portion 68 of second slots 64 and by cross braces 48 and 50. Front brace 48 is positioned below seat portion 20 and rear cross brace 50 is positioned below back portion 18 to support seat portion 20 and back portion 18 when frame 12 is in the bed position.

In order to move frame 12 from the bed position, depicted in FIG. 1 to the seating position depicted in FIG. 3, the user first lifts seat portion 20 about hinge 22 in the direction of arrow 24 by lifting and rotating outer end 88 in the direction of arrow 24 to the position just past the position of seat portion 20 as depicted in FIG. 2. Kicker 74 is free to swing about pivot 86 and second end 82 initially falls below inner end 90 as second end 82 is no longer supported and held in place by front cross brace 48.

As seat portion 20 is pivoted past a vertical position second ends 82 of kicker 74 can be moved above corresponding kicker contact areas 84 of contact extensions 72. The user then moves outer end 88 forwardly and downwardly about hinge 22 in the direction of arrow 25 until second ends 82 contact kicker contact areas 84. Connecting portion 78 will ensure that second ends 82 move in a coordinated manner with both second ends 82 contacting respective kicker contact areas 84 simultaneously.

Further movement of outer end 88 in the direction of arrow 25 will cause pivotal force to be applied on kicker contact areas 84 by ends 82. This forces back portion 18 to pivot upwardly and inwardly in the direction of arrow 27 constrained by pins 52 in slot 54 and pins 62 in second slots 64. This movement causes pin 52 to be moved in the direction generally of arrow 27 and as contact surface 92 is oriented generally parallel with the initial movement of pin 52 in the direction of arrow 27, pin 52 is released from contact surface 92. Further movement of outer end 88 in the direction of arrow 25 causes pin 52 to be moved upwardly along slot 54. The movement of back portion in the direction of arrow 27 also causes pin 62 to be moved rearwardly along second slot 64 into the long angled portion 70.

The movement of outer end 88 in the direction of arrow 27 is continued until the bottom of end members 32 contact front brace 48 and support region 96 contacts supporting surface 16. Stop 98 should then be positioned beside front cross brace 48 preventing forward movement of seat members 32.

In order to move the futon frame between the seat position, depicted in FIG. 3 to the bed position depicted in FIG. 1, the user lifts outer end 88 upwardly releasing stop 98 from front cross brace 48 and pulls forwardly on seat members 32. This moves the lower portion of back portion 18 adjacent hinge 22 forwardly forcing pin 62 along second slot 64 in the direction of horizontal portion 68. Back 18 thereby pivots about rear cross brace 50 which causes pin 52 to move downwardly along slot 54. This forward movement ultimately results in pin 62 moved into horizontal portion 68 and pin 52 moved downwardly into curved region 60 to contact surface 92. The forward movement of seat members 32 forces body section 76 to be moved along front cross brace 48 thereby lifting second ends 82 upwardly to orient body section 76 in alignment with end members 32 with body members resting on front cross brace 48. Frame 12 is then in the bed position, as depicted in FIG. 1.

We claim:

1. A futon frame convertible between a bed position and a sitting position, comprising:

(a) a back portion oriented generally upright when the frame is in the sitting position and oriented horizontally when the frame is in the bed position the back portion comprising a pair of opposed outer edges;

(b) a seat portion hingedly attached to the back portion to permit relative movement of the back portion with respect to the seat portion;

(c) a connector releasably connecting the back portion and seat portion to cause the back portion to move on movement of the seat portion in a first direction about a pivot axis;

(d) a support for supporting the back portion with respect to a supporting surface;

(e) a pair of first pins, each connected to one of the outer edges of the back portion and the support;

(f) a pair of first slots, each in the other of the outer edges of the back portion and the support, for constraining movement of the first pins within respective first slots, each first slot comprising a contact surface preventing upward movement of the pins with respect to the first slots when the frame is in the bed position and positioned such that the pins are releasable from the contact surface upon movement of the back portion in the first direction, when the frame is moved from its bed position to its sitting position;

(g) the contact surfaces are curved and comprise an upper segment of the surfaces of the first slot.

2. The frame as described in claim 1 wherein the contact surfaces are curved with a radius of between about 45 mm and 55 mm.

3. The frame as described in claim 1 wherein the contact surfaces are curved with a radius of between about 48 mm and 52 mm.

4. The frame as described in claim 1 wherein the contact surfaces are curved with a radius of about 50 mm.

5. The frame as described in claim 4 wherein the first direction is curved having a radius of about 50 mm.

6. The frame as described in claim 1 wherein the contact surfaces are dimensioned generally in length at least equal to the diameter of the first pin.

7. The frame as described in claim 1 wherein the contact surfaces are oriented generally parallel with the first direction as the frame is moved from its bed position toward its sitting position.

8. The frame as described in claim 1, wherein the first slots and first pins are oriented with respect to the back portion so that the first pins are located substantially at the top of the slots when the frame is in the sitting position and so that the first pins are located adjacent the contact surfaces when the frame is in the bed position.

9. The frame as described in claim 8 wherein the first ends are located at a forward section of the seat portion opposite the end of the seat portion connected to the back portion.

10. The frame as described in claim 1 further comprising:

(a) a pair of second pins each located at one of the outer edges of the back portion and the support, each one below a respective one of the first pins when the frame is in the sitting position;

(b) a pair of second slots each located in the other of the outer edges of the back portion and the support, comprising a horizontal section aligned horizontally with respect to the lower portion of the curved section of the first slot, such that the second pin is in the horizontal portion when the frame is in its bed position.

11. The frame as described in claim 10 wherein the connector comprises a kicker having a pair of first ends hingedly connected to opposite ends of the seat portion and a pair of second ends for releasable engagement with opposite segments of the back portion, the second ends engaging the back portion when the seat portion and the back portion are oriented perpendicularly with respect to each other and wherein the second pins act as the pivot point, whereby downward motion on the seat portion when the second portions of the kicker are engaged with the back portion causes the back portion to move in the first direction and the pair of first pins to move generally in a direction parallel to the contact surfaces to move the first pins past the contact surfaces.

12. The frame as described in claim 11 wherein the seat portion further comprises a stop for engaging the support and releasably retaining the frame in the sitting position.

13. The frame as described in claim 11 wherein the back portion comprises a pair of kicker contact surfaces for contacting the second portion of the kicker, the kicker contact surfaces located below the hinge when the frame is in the sitting position.

14. A kicker for a futon frame convertible between a sitting position and a bed position, the futon frame including a seat portion having outer and inner ends, the seat portion hingedly connected to a back portion, the kicker comprising:

(a) a pair of elongated body sections each having a first end hingedly connected to the seat portion and a second end for contacting the back portion, joined together by a connecting portion;

(b) a pair of kicker contact areas connected to the back portion for contacting respective second ends of the body sections, located below the hinge when the frame is in its sitting position;

(c) the length of each body section being substantially equal to the distance between the outer end of the seat portion and the inner end of the seat portion;

(d) The connecting portion causing each body section to operate in a coordinated manner with the other body section to simultaneously engage and disengage the kicker from the kicker contact area.

15. A guide for a back portion of a sofa bed frame convertible between a bed position and a sitting position, the guide comprising:

(a) a support for supporting the back portion with respect to a support surface;

(b) a pin connected to one of the support and the back portion, the pin moving when the frame is moved from the bed position to the sitting position;

(c) a slot in the other of the support and the back portion oriented to constrain the pin to move within the slot;

(d) the slot comprising a contact region contacting the pin when the bed frame is in the bed position to prevent vertical movement of the pin in the slot and positioned so that the contact region is substantially parallel with the direction of movement of the pin when moved upon initial movement of the back portion when the frame is moved from the bed position to the sitting position;

(e) the contact surfaces are curved and comprise an upper segment of the surfaces of the first slot.

16. The guide as described in claim 15 wherein the contact region is curved with a radius of between about 45 mm and 55 mm.

17. The guide as described in claim 15 wherein the contact region is curved with a radius of between about 48 mm and 52 mm.

18. The guide as described in claim 15 wherein the contact region is curved with a radius of about 50 mm.

19. A futon frame convertible between a bed position and a sitting position, comprising:

(a) a back portion oriented generally upright when the frame is in the sitting position and oriented horizontally when the frame is in the bed position the back portion comprising a pair of opposed outer edges;

(b) a seat portion hingedly attached to the back portion to permit relative movement of the back portion with respect to the seat portion;

(c) a connector releasably connecting the back portion and seat portion to cause the back portion to move on movement of the seat portion in a first direction about a pivot axis;

(d) a support for supporting the back portion with respect to a supporting surface;

(e) a pair of first pins, each connected to one of the outer edges of the back portion and the support, (f) a pair of first slots, each in the other of the outer edges of the back portion and the support, for constraining movement of the first pins within respective first slots each first slot comprising a contact surface preventing upward movement of the pins with respect to the first slots when the frame is in the bed position and positioned such that the pins are releasable from the contact surface upon movement of the back portion in a first direction, when the frame is moved from its bed position to its sitting position; and (g) the contact surfaces are curved rearwardly away from the seat portion from the top to the bottom of the contact surface.

20. The frame as described in claim 19 wherein the contact surfaces are curved with a radius of between about 45 mm and 55 mm.

21. The frame as described in claim 19 wherein the contact surfaces are curved with a radius of between about 48 mm and 52 mm.

22. The frame as described in claim 19 wherein the contact surfaces are curved with a radius of about 50 mm.

23. The frame as described in claim 19 wherein the contact surfaces are dimensioned generally in length at least equal to the diameter of the first pin.

24. The frame as described in claim 19 wherein the contact surfaces are oriented generally parallel with the first direction as the frame is moved from its bed position toward its sitting position.

25. The frame as described in claim 19 wherein the contact surfaces comprise an upper segment of the surfaces of the first slots.

26. The frame as described in claim 19 wherein the first slots and first pins are oriented with respect to the back portion so that the first pins are located substantially at the top of the slots when the frame is in the sitting position and so that the first pins are located adjacent the contact surfaces when the frame is in the bed position.

27. The frame as described in claim 19 further comprising:

(a) a pair of second pins each located at one of the outer edges of the back portion and the support, each one below a respective one of the first pins when the frame is in the sitting position, (b) a pair of second slots each located in the other of the outer edges of the back portion and the support, comprising a horizontal section aligned horizontally with respect to the lower portion of the curved section of the first slot, such that the second pin is in the horizontal portion when the frame is in its bed position.

28. The frame as described in claim 27 wherein the connector comprises a kicker having a pair of first ends hingedly connected to opposite ends of the seat portion and a pair of second ends for releasable engagement with opposite segments of the back portion, the second ends engaging the back portion when the seat portion and the back portion are oriented perpendicularly with respect to each other and wherein the second pins act as the pivot point, whereby downward motion on the seat portion when the second portions of the kicker are engaged with the back portion cases the back portion to move in the first direction and the pair of first pins to move generally in a direction parallel to the contact surfaces to move the first pins past the contact surfaces.

29. The frame as described in claim 28 wherein the seat portion further comprises a stop for engaging the support and releasably retaining the frame in the sitting position.

30. The frame as described in claim 28 wherein the back portion comprises a pair of kicker contact surfaces for containing the second portion of the kicker, the kicker contact surfaces located below the hinge when the frame is in the sitting position.

31. A guide for a back portion of a sofa bed frame convertible between a bed position and a sitting position, the guide comprising:

(a) a support for supporting the back portion with respect to a support surface;

(b) a seat portion hingedly attached to the back portion;

(c) a pin connected to one of the support and the back portion, the pin moving when the frame is moved from the bed position to the siting position;

(d) a slot in the other of the support and the back portion oriented to constrain the pin to move within the slot;

(e) the slot comprising a contact region contacting the pin when the bed frame is in the bed position to prevent vertical movement of the pin in the slot and positioned so that the contact region is substantially parallel with the direction of movement of the pin when moved upon initial movement of the back portion when the frame is moved from the bed position to the siting position; and (f) the contact surfaces are curved rearwardly away from the seat portion from the top to the bottom of the contact surface.

32. The guide as described in claim 31 wherein the contact region has a radius of between about 45 mm and 55 mm.

33. The guide as described in claim 31 wherein the contact region has a radius of between about 48 mm and 52 mm.

34. The guide as described in claim 31 wherein the contact region has a radius of about 50 mm.

* * * * *

UNITED STATES PATENT AND TRADEMARK OFFICE

CERTIFICATE OF CORRECTION

PATENT NO. : 6,138,300
DATED : October 31, 2000
INVENTOR(S) : Burch et al.

It is certified that error appears in the above-identified patent and that said Letters Patent is hereby corrected as shown below:

Column 11,
Lines 46-47, change "slots each" to -- slots, each --

Signed and Sealed this

Seventh Day of May, 2002

*Attest:*

*Attesting Officer*

JAMES E. ROGAN
*Director of the United States Patent and Trademark Office*